US005656995A

United States Patent [19]

Peters

[11] Patent Number: 5,656,995

[45] Date of Patent: Aug. 12, 1997

[54] OBJECT PRESENCE DETECTION METHOD AND SYSTEM HAVING QUICK OBJECT DEPARTURE DETECTION TO TURN OFF SYSTEM

[75] Inventor: Wayne J. Peters, Roscoe, Ill.

[73] Assignee: Hampton Electronics, Rockford, Ill.

[21] Appl. No.: 235,478

[22] Filed: Apr. 29, 1994

[51] Int. Cl.[6] ..... G08B 13/00

[52] U.S. Cl. ..... 340/541; 315/307; 340/309.15

[58] Field of Search ..... 340/567, 565, 340/528, 541, 309.15; 250/342, DIG. 1; 377/6; 315/307

[56] References Cited

U.S. PATENT DOCUMENTS

| | | | |
|---|---|---|---|
| 4,703,171 | 10/1987 | Kahl et al. | 340/567 X |
| 4,799,243 | 1/1989 | Zepke | 340/567 X |
| 4,993,049 | 2/1991 | Cupps | 340/567 X |
| 5,386,210 | 1/1995 | Lee | 340/567 |

*Primary Examiner*—Thomas Mullen
*Attorney, Agent, or Firm*—Harold A. Williamson

[57] ABSTRACT

The invention is directed to a detection system for detecting object presence in a detection zone and always detecting object departure from the detection zone so as to provide an object presence detection zone output signal indicative of zone occupancy. The system is comprised of a main system control unit mutually responsive to both an object presence signal from the zone and an object departure signal form the zone to provide the object presence detection zone output signal "ON". The object presence detection zone output signal remaining "ON" for a preset time period, which preset time period is retriggered "ON" as long as presence of an object in the zone is detected. The object departure signal causes a discrete moment of departure time delay signal that causes the object presence detection zone output signal to mm "OFF" when no object presence is detected in the zone during the discrete moment of departure time delay. The main system control unit is further responsive to the triggering/retriggering of the preset time period "ON" and the time delay moment of departure to ensure that the object presence detection zone output signal is "ON" during the triggering/retriggering and the discrete moment of departure time delay and is turned "OFF" just after the discrete moment in time and object departs the zone and no object has been detected in the zone.

8 Claims, 6 Drawing Sheets

| A | B | Z |
|---|---|---|
| 0 | 0 | 0 |
| 0 | 1 | 0 |
| 1 | 0 | 0 |
| 1 | 1 | 1 |

| A | B | Z |
|---|---|---|
| 0 | 0 | 0 |
| 0 | 1 | 1 |
| 1 | 0 | 1 |
| 1 | 1 | 1 |

OBJECT PRESENCE DETECTION METHOD AND SYSTEM HAVING QUICK OBJECT DEPARTURE DETECTION TO TURN OFF SYSTEM

FIELD OF THE INVENTION

A detection system for detecting object presence in a detection zone and for detecting object departure from the detection zone so as to provide an object presence detection zone output signal. The output signal may be utilized in applications involving the prevention of property invasion, energy savings, as well as, automation of dwellings for the aged and handicapped.

BACKGROUND OF THE INVENTION

Over the years there have been a multitude of systems for the detection of motion within a given zone or field of view. These systems include optical, ultrasonic, electromagnetic, electrostatic, microwave and passive infrared sensors. The passive infrared sensors may be of a type that include a pyroelectric component of a nature which exhibits an electrical voltage or a change of electrical resistance in response to infrared radiation which is radiated by an object, for example, a human body. Circuits in the sensor detect this change and respond by transmitting an actuating signal to one or more electrically controlled devices that are to be turned on when the object is in a zone monitored by the sensor. Such sensors may also include means for intercepting infrared that arrives from different directions and for concentrating the infrared at the location of the pyroelectric component. Typical of such detection systems is that shown in the Jacob Fraden U.S. Pat. No. 4,450,351 ('351) which describes an optical system for motion discontinuance detection in an optical field of view that has the ability to turn lights off in a room. The system produces an output signal change upon the discontinuance of motion within the field of view and not by the presence of motion within the field of view.

The Galvin et al U.S. Pat. No. 4,636,774 ('774) is directed to a motion detector together with associated A C switching circuitry which form a lighting control system which turns on room lights when the room is occupied and extinguishes the lights when the room is unoccupied. The '774 invention is specifically directed to a dual sensitivity motion detector which requires a substantial initial motion disturbance to turn on the lights, but once the lights are turned on the motion detector becomes highly sensitive to any motion in the room thereby keeping the lights on.

The Pfister et al U.S. Pat. No. 4,746,910 ('910) discloses a passive infrared intrusion detector which employs correlation analysis. The '910 invention employs a pair of sensors wherein signals obtained from a first sensor are indicative of motion detected in a region. These signals are continuously compared in a correlator with reference to set signals stored in a read-only memory and/or with actual signals obtained from a second sensor monitoring the region.

The W. Lee U.S. Pat. No. 5,066,855 is directed to the idea of motion monitoring two fields of view by means of a single sensor and an optical device.

The Hershkovitz et al U.S. Pat. No. 5,077,549 is directed to an integrating passive infrared intrusion detector where a signal responsive to infrared radiation received from optically divided zones of an area to be monitored is integrated to produce an integral sum to generate an alarm indication.

The A. L. Hermans U.S. Pat. No. 5,221,919 is directed to a room occupancy sensor of a standard pyrotechnic type which receives infrared energy from parties entering a room by means of a novel dome shaped collection of fresnel lenses that focus the infrared energy on a sensor.

The Ichikawa U.S. Pat. No. 5,153,560 ('560) is directed to apparatus for detecting presence of a person inside a room having a door. The apparatus includes a pyroelectric infrared sensor and a piezoelectric air pressure sensor. The infrared sensor detects movement of a person and produces a signal indicating movement. The air pressure sensor detects opening and closing of the door and produces a signal indicating the opening and closing of the door. A logic device is connected between the-outputs; of the two sensors. When the signal indicating the movement is applied to the logic device later than the signal indicating the opening and closing of the door, the logic device produces a signal indicating the entry of a person. When the signal indicating the opening and closing of the door is applied to the logic device later than the signal indicating the movement of a person the logic device produces a signal indicating the exit of a person.

The apparatus in the '560 patent makes no provision to turn lights "OFF" in a room in a shorter period of time than set by a monostable multivibrator **4*e* shown in FIG. 1** of the patent.

Total system operation of the '560 patent is inherently compromised in the event a door is simply left opened and not closed.

From the foregoing review of the prior art it is apparent that there are many approaches to detecting persons or objects in a zone or area of view as well as optical lenses to focus infrared energy. Some of the patents even note the need to maintain the lights to an area turned on for a period of time in the zone or area after the person is no longer detected or has departed the zone or area.

Herein reside the source of a major problem now facing a segment of lighting control industry that urges the use of automatic motion sensing to turn lights "ON" and "OFF" in a room, area or zone. Typically these motion control light switches include logic circuitry that is designed to maintain the light "ON" for a period of time e.g. 10 to 20 minutes after any bodily motion is detected. This ensures that the light remains "ON" until there is some further physical activity, which activity again triggers a 10 to 20 minute "ON" cycle.

A major disadvantage of this arrangement resides in the fact that during building occupancy hours a momentary visitor from time-to-time steps into an unoccupied room to pick up an item or drop off mail which triggers the light to turn "ON". Even though the momentary visitor leaves the room almost instantly the light remains on for another 20 minutes, much to the annoyance of an energy savings minded owner occupant that has installed the motion sensing light control switch to save electricity. One way to reduce the lighting electrical costs brought about by momentary visitors is to reduce the length of time a light remains "ON" following motion detection of a room occupant. However, the shorter the time period the greater the likelihood the room occupant motion will not be detected because they have become engrossed in their work and are remaining motionless. When the lights in the room turn "OFF" shortly after they have begun to concentrate on their work, the concentration is interrupted by the room occupant needing to wave an arm to cause the motion detecting light switch to turn the lights back "ON". Many room occupants find this arm waving activity maddening. As a consequence of this just described annoying characteristic of the lights turning "OFF" too quickly the room occupants, when possible, set the time period for the lights to be on for as long as possible thereby defeating in part the building owners efforts to save electricity due to momentary visitors.

Business and industry go through cycles of belief with respect to worker productivity as such productivity is related to private fully enclosed office space and wide open office areas partitioned off into smaller work areas. These cycles on the one hand create many private offices, each with a potential to experience unneeded lights "ON" due to momentary visitors and an off-hours phenomenon where a single employee needs to work thereby requiring all lights in a vast wide open office area to be turned "ON" when in fact only a small section of lighting in a zone the office worker is occupying is required. It is not uncommon to find an office worker departing the wide open office area and not turning off the lights because a master panel controlling all of the lights in the office area is not convenient to the worker on the way out.

The invention to be described hereinafter completely obviates the problems defined earlier which problems are not addressed by the prior art described herein before.

SUMMARY OF THE INVENTION

The invention is directed to an object presence detection method and system which provides quick object departure detection to turn off the system.

More specifically the method involves a technique of detecting an objects presence in a detection zone and for quickly detecting object departure from the detection zone to provide an object presence detection zone output signal. This signal, when "ON", indicates the presence of an object in the zone. Alternatively the zone output signal is "OFF" at an instant following a moment of departure of the object from the zone when no presence of an object in the detection zone is detected during the moment of departure. The method comprises the steps of:

(a) detecting the presence of an object in the detection zone to trigger "ON" the object presence detection zone output signal for a preset time period, (b) retriggering the preset time period as long as object presence is detected in the zone, (c) detecting object departure from the detection zone, and (d) resetting to "OFF" the object presence detection zone output signal at the instant in time just after the moment in time an object has been detected departing the detection zone and no object has been detected in the zone during the moment in time.

The system, more specifically, is directed to a detection system for detecting object presence in a detection zone and quickly detecting object departure from the detection zone so as to provide an object presence detection zone output signal indicative of zone occupancy. The system is comprised of a main system control unit that is responsive to both an object presence signal from the zone and an object departure signal from the zone to central an "ON" and "OFF" of the object presence detection zone output signal. The object presence signal acts to trigger the detection zone output signal "ON". The object presence detection zone output signal remains "ON" for a preset period of time. The object presence detection zone output "ON" signal is maintained "ON" as; long as presence of an object in the zone is detected.

The object departure signal causes a discrete moment of departure time delay While simultaneously interrupting the preset time period and the object presence detection zone output signal to "OFF" when no object presence is detected during the discrete moment of departure time delay from the zone.

The main system control unit is further responsive to the triggering/retriggering of the preset time period "ON" and the time delay moment of departure to ensure that the object presence detection zone output signal is "ON" during the triggering/retriggering and the discrete time delay moment of departure and is turned"OFF" just after the discrete moment in time an object departs the zone and no object has been detected in the zone.

It is therefore a primary object of the invention to provide an object detection system that quickly turns off a zone output detection signal after an object departs a detection zone without regard to how long this system may be maintaining the lights "ON" in a detection zone because of object motion detection in the zone.

Another object of the invention is to provide object detection in a zone and object departure from the zone by sharply defining a perimeter of the zone from which the object departs while simultaneously ensuring that object departure from the zone promptly causes an indication that there are no objects in the zone.

in the attainment of the foregoing objects the invention contemplates as falling within the purview of the claims a detection system for detecting object presence in a detection zone and quickly detecting object departure from the detection zone to provide an object detection zone output signal indicative of zone occupancy. The system includes a main system control unit having a mutually responsive object presence/object departure unit that is mutually responsive to both an object presence signal from the detection zone and an object departure signal from the detection zone to provide the object presence detection zone output signal.

The object presence/object departure unit also provides an object presence detection zone "ON" signal. This signal is "ON" for a predetermined time period. A moment of departure time delay signal is also provided. The object presence signal initiates the preset time period "ON" signal. The object presence signal also retriggers "ON" the preset time period for the preset time period as long as presence of an object in the zone is detected, i.e. the zone is occupied by an object. In other words if the preset time period is 20 minutes and 10 of the 20 minutes have elapsed with no object detected and then an object is detected, the preset 20 minute time period will be retriggered "ON" for an additional 20 minutes. Accordingly if no further object is detected, the total "ON" time will be 30 minutes, i.e. 10+20 minutes.

The object departure signal causes the moment of departure time delay signal to be initiated. The moment of departure time delay signal indicates the departure of an object from the zone. The appearance of the object departure signal acts to interrupt the preset time period and the object presence detection zone output signal when no object presence is detected during the time delay moment of departure time from the zone. A detailed explanation of how the object departure signal cooperates with other components in the system is set forth in detail in the specification in a description of FIG. 4.

The main system control unit further includes a retrigger hold delay unit that is responsive to the object presence detection zone output "ON" signal and the moment of departure time delay signal to deliver a zone unoccupied signal to the responsive object presence/object departure unit to ensure that the object presence detection zone output signal is "ON" during detection of objects in the zone, as well as, during said time delay moment of departure. The nature and function of the zone unoccupied signal is setforth in the specification in a description of FIG. 4. Thereafter at a discrete instant or point in time just following the end of the moment of departure time delay the object presence detection zone output signal is turned "OFF" which indicates object departure from the zone and that no other object has been detected in the zone.

Both the method and system, hereinbefore described contemplate in a preferred embodiment that the preset time period "ON" signal is always longer in time duration than the time delay moment of departure signal

BRIEF DESCRIPTION OF THE DRAWINGS

The description set forth above, as well as other objects, features and advantages of the present invention, will be more fully appreciated by referring to the detailed description and drawings that follow. The description is of the presently preferred but, nonetheless, illustrative embodiments in accordance with the present invention, when taken in conjunction with the accompanying drawing wherein.

DETAILED DESCRIPTION OF THE PREFERRED EMBODIMENTS

Figure 1:
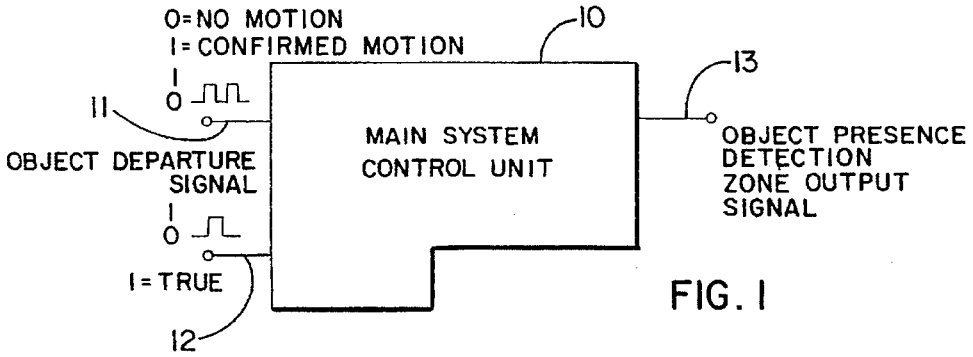
FIG. 1 is a block diagram of a system that embodies the object detection concept of the invention.

Reference is now made to FIG. 1 which illustrates in block diagram form an object detection system which embodies the invention. At the outset it should be understood that object detection systems may be passive or active. By passive it is meant to indicate that a passive mechanism or apparatus is provided that generates or produces an output signal indicative of the presence of an object within a three dimensional zone or field of view whenever the nature of the object is such that it provides radiated data to the passive apparatus which has a pyroelectric infrared sensor that has a predetermined field of view.

Active sensors are represented by a family of well known apparatus that emit, transmit or send signals into a zone or field of view where the emitted, transmitted or sent signals interact in some way with the Object and a receiver that cooperates with the emitting, transmitting or sending apparatus to provide an output signal indicative of the presence of an object in the zone or field of view. Active apparatus of the nature just described may be optical, ultrasonic, electromagnetic and microwave to name a few. The subject invention would find utility with either passive or active detection systems of the nature just described. It is to be noted that in the preferred embodiments of the invention passive object detection devices of the infrared pyrolectric type are preferred because of their low level power consumption requirements.

Attention is again directed to FIG. 1 where the object detection system of the invention is shown to include in block diagram form a main system control unit 10 that is responsive to an object presence signal on input lead 11 and an object departure signal on input lead 12. The object presence signal is generated by an object detected in a detection zone as will be described hereinafter with respect to FIGS. 9 and 11. The object departure signal is provided by a device associated with the detection zone. As previously noted the presence and departure detection sensors signals can be generated by any of a number of technologies. These signals, although not shown in the drawings, would experience signal conditioning based on the technology used as well as filtering to confirm actual input conditions by removing false triggering due to noise etc.

The object presence signal inputed in lead 11 to the main system control unit 10 causes an object presence detection zone output signal to turn "ON" and remain "ON" for a preset time period which time period is retriggered "ON" for the preset time period as long as the presence of an object is detected in the zone thereby indicating zone occupancy.

The object departure signal on input lead 12 to the main system control unit 10 causes the object presence detection zone output signal on output lead 13 to turn "OFF" just after a moment in time an object departs the zone and no object has been detected in the zone during the departure moment in time. In a highly preferred embodiment of the invention the moment in time is always shorter than the preset time period.

In the description that follows a discrete instant in time is defined as a finite point in time as distinguished from a period of time which may be long or short. Throughout the specification and appended claims the phrase "moment in time" is defined to mean a "short period of time" rather than an instantaneous finite, discrete point in time.

Figure 2:
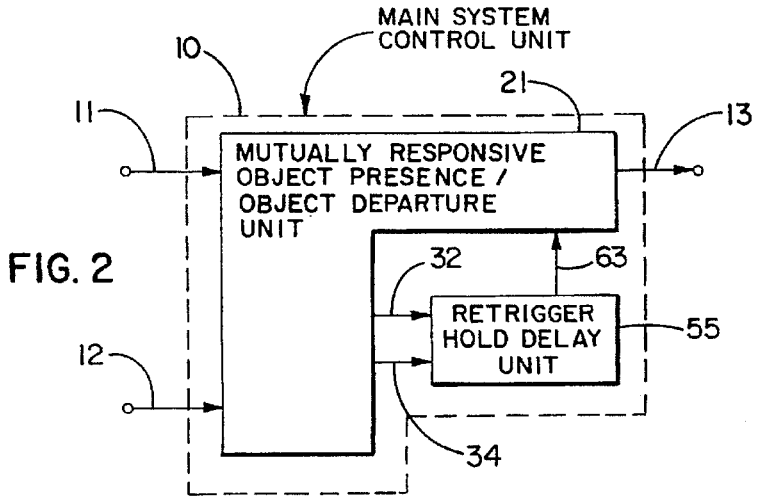
FIG.2 is a block diagram of the system depicted in FIG. 1 with additional features shown in block diagram form.

As the detailed description of the invention unfolds it is to be kept in mind that in the preferred embodiment there is an overall objective to turn lights "OFF" in a detection zone immediately following the departure of an object, here a person from the detection zone, when no one remains detected in the zone immediately after the person's departure from the zone, A study of FIG. 2 reveals that the main system control unit 10 includes a mutually responsive object presence/object departure unit 21 electrically coupled to receive the object presence signal on input lead 11 and the object departure signal on input lead 12. The mutually responsive object presence/object departure unit provides the object presence detection zone output signal on output lead 13 as well as a preset time period "ON" signal on lead 32 and a time delay moment of departure signal on lead 34. Leads 32 and 34 are shown as inputs to a retrigger hold delay unit 55 which provides a zone unoccupied signal on lead 63 to mutually responsive object presence/object departure unit 21.

Figure 3:
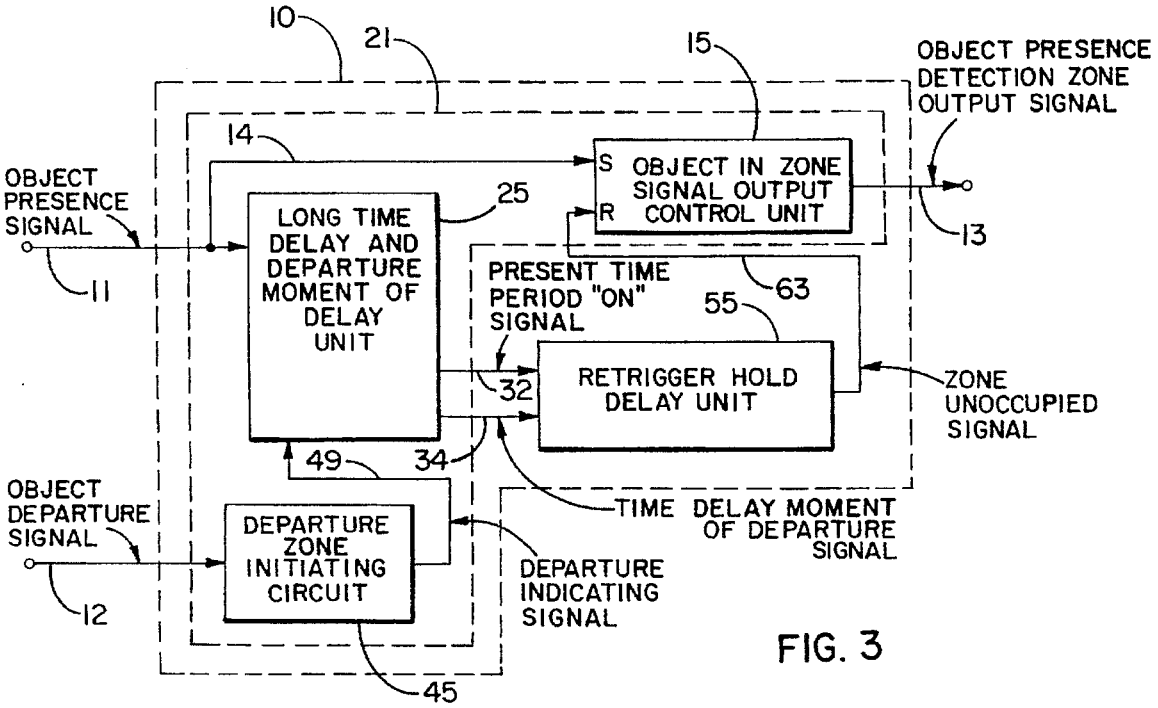
FIG. 3 depicts in block diagram form a further amplification of the details of the invention shown in FIGS. 1 and 2.

An investigation of FIG. 3 reveals that the mutually responsive object presence/object departure unit 21 is comprised of a long time delay and departure moment of delay unit 25 which receives an object presence signal on input lead 11. Departure zone initiating circuit 45 receives an object departure signal on input lead 12. The departure initiating circuit 45 provides an output departure indicating signal to the long time delay and departure moment of delay unit 25. The just mentioned delay unit 25 is jointly controlled by the object presence signal on lead 11 and the departure indicating signal on lead 49. The long time delay and departure moment of delay unit 25 delivers on lead 32 a preset time period "ON" signal and a time delay moment of departure signal on lead 34, as shown.

An object in zone signal output control unit 15 is turned "ON" by an object presence signal on leads 11,14. The object in zone signal output control unit 15 is reset by the appearance of a zone unoccupied signal on lead 63 from the retrigger hold delay unit 55.

Figures 4, 4A, 4B:
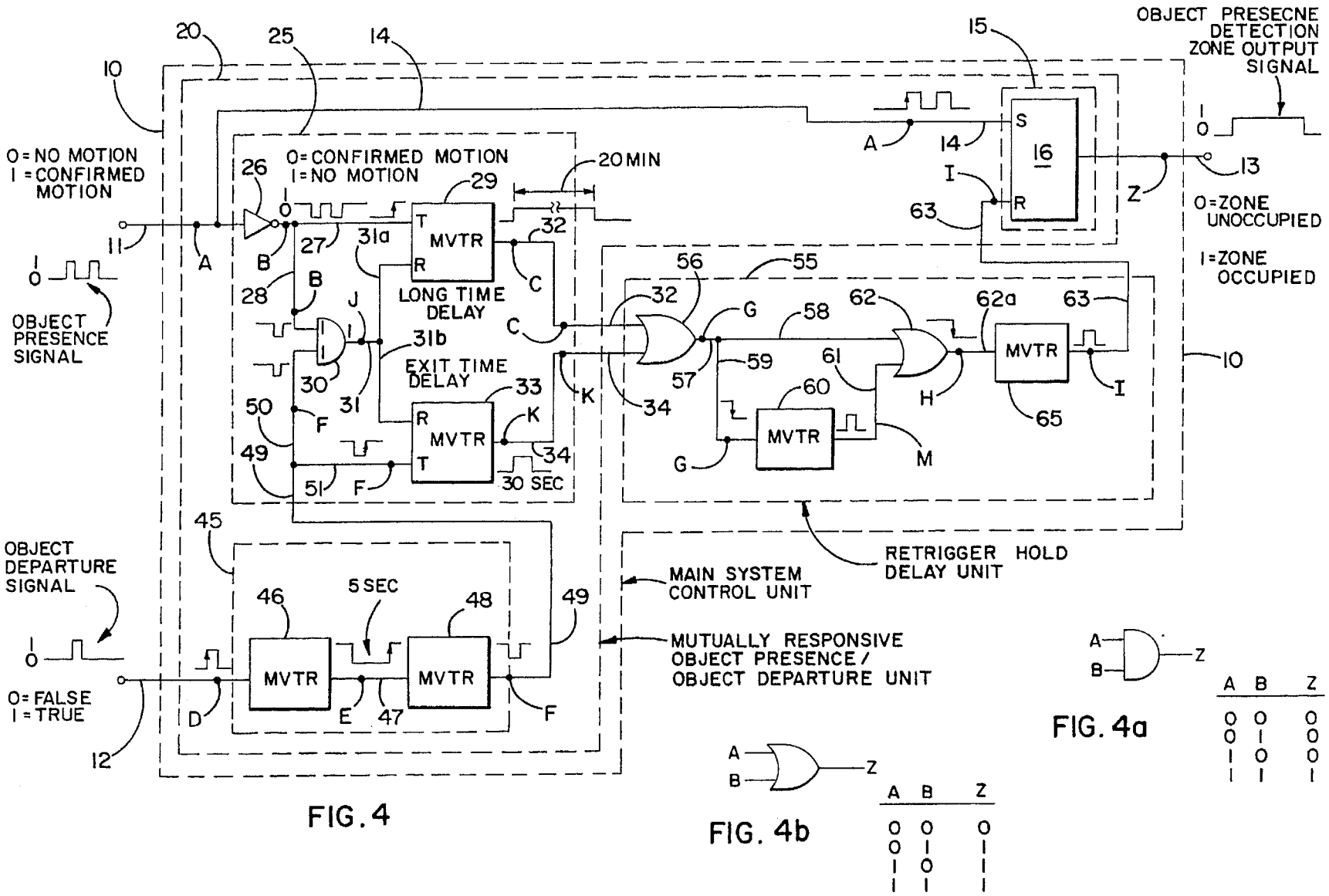
FIG. 4 is a logic circuit block diagram of a system and apparatus that illustrates a preferred embodiment of the invention.
FIGS. 4*a* and 4*b* are truth tables.

A detailed showing of logic circuitry that will allow others to make and practice the invention is depicted in FIG. 4. A glance at FIG. 4 quickly reveals as is shown in dotted outline the main control system 10 which includes mutually responsive object presence/object departure unit 20 and the retrigger hold delay unit 55 the overall functions of which have been described earlier. The mutually responsive unit 20 is also shown to include in dotted outline the long time delay and departure moment of delay unit 25 and the zone departure initiating circuit 45, the broad functions of which have been described earlier.

The description that follows will initially entail a description of the details of the logic circuitry which will then be followed with an integration of waveform analysis and logic circuit detail to afford the reader a complete understanding of the operation of the system.

Accordingly it will be noted in FIG. 4 that an object presence signal on input lead 11 will be delivered over leads 11, 14 to the "object in zone signal output control unit" 15 which is shown here as a flip-flop 16. The leading edge of the object presence signal will trigger on the flip-flop 16 to produce the object presence detection zone output signal on output lead 13.

The mutually responsive object presence/object departure unit 20 also includes the long time delay and departure moment of delay unit 25 which also receives and responds to the object presence signal on input lead 11. This object presence signal on lead 11 passes through a signal inverter 26 to be delivered over lead 27 where the positive going edge of the signal triggers a monostable multivibrator 29 which produces a long time delay output signal as indicated on output lead 32. The time delay is here indicated at 20 minutes. The period of this time delay may be selected to be of any given length of time, and is usually selected to provide a period of time during which subsequent movement of an object will be detected and cause the multivibrator 29 to be retriggered on. If the time delay is set for a very short period of time and the object is a person that enters the detection zone and then sits down and because of the stillness of their positions they are not detected, then as will be explained hereinafter the object presence detection zone output signal on output lead 13 will turn "OFF". Where the output signal on lead 13 is employed to control lighting within a detection zone, the lighting will be turned "OFF" leaving the just noted person in an unlighted zone. As will be appreciated later in the description of system operation any subsequent movement by a person or object in the zone will turn "ON" the lighting. If the time delay period is very short and the person sits very still, the person will be repeatedly required to manifest some detectable motion such as raising or waving an arm. This arm waving activity as noted earlier is annoying to most people as it tends to interrupt their thought processes.

Returning now to the logic circuit diagram of FIG. 4 it will be noted that the inverted output object presence detection signal will also be delivered over lead 28 to AND gate 30. Before any further circuit description of the long time delay and departure moment of delay unit 25 will be undertaken, attention will be directed to the electrical nature of the zone departure initiating circuit 45 shown in dotted line just below that which has just been described.

The zone departure initiating circuit 45 receives an object departure signal of the nature shown on input lead 12 to a multivibrator 46. A positive going edge of the object departure signal triggers "ON" the multivibrator 46 to provide the inverted wave form pulse shown immediately above lead 47 to multivibrator 48. For reasons that will become apparent hereinafter the output of the multivibrator 46 which is normally high will go low as shown for 5 seconds. This 5 second delay, which could be more or less, allows for an object/person to exit the zone while simultaneously initiating an exiting process, to be described, which uses an object presence signal for confirmation of occupancy.

The output of the multivibrator 48 is normally high and is triggered to produce a signal shown just above lead 49 when a positive going portion of the 5 second signal appears. The multivibrator 48 output pulse signal just described indicates that 5 seconds is over and the just noted exit process is to be initiated.

Returning now to the logic circuit description of the long time delay and departure moment of delay unit 25, it will be observed that the output signal just described on lead 49 is delivered via leads 49,50 to the AND gate 30 and to an exit time delay multivibrator 33 over lead 51 where a positive going portion of the pulse signal from the multivibrator 48 will trigger "ON" a 30 second time delay output signal as shown just beneath lead 34. The AND gate 30 has an output lead 31 that is electrically connected via leads 31*a* and 31*b* to a reset terminal on the long time delay multivibrator 29 and the exit time delay multivibrator 33. The multivibrator 29 is connected via lead 32 to an OR gate 56 of the retrigger hold delay unit 55, whereas,the multivibrator 33 is connected via lead 34 to the same OR gate 56.

The retrigger hold delay unit 55, shown in dotted line includes as just described, an OR gate 56 that receives via lead 32 a preset time period "ON" signal and a time delay moment of departure signal on lead 34. The OR gate 56 is further connected via leads 57, 58 to OR gate 62. The OR gate 56 is also connected to multivibrator 60 via leads 57, 59. The output of multivibrator 60 is connected to the remaining input of OR gate 62 via lead 61. The OR gate 62 via lead 62*a* delivers a signal to a multivibrator 65 which produces on lead 63 a zone unoccupied reset signal to the flip-flop 16 as noted earlier.

SYSTEMS OPERATION

Figure 5:
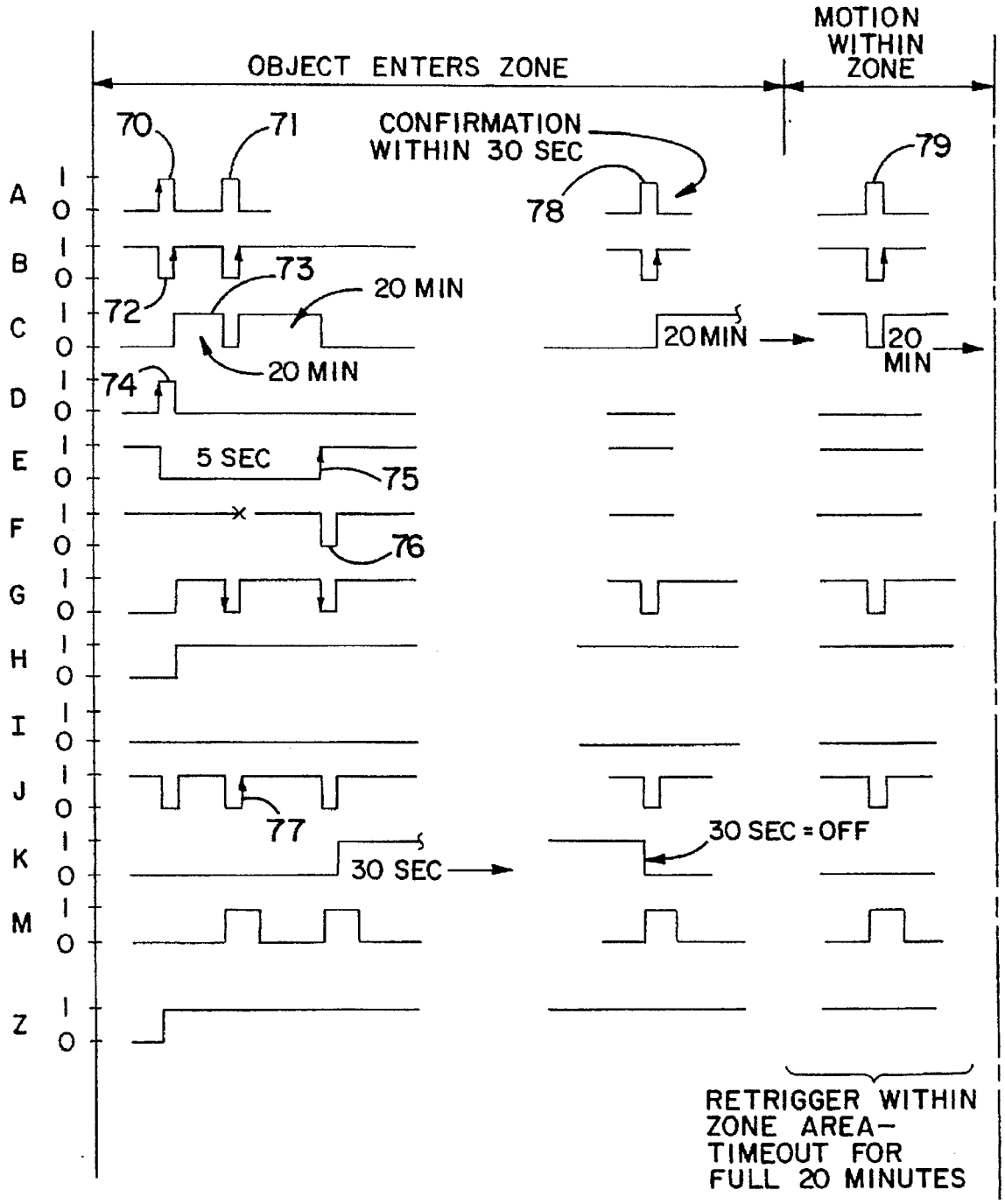
FIG. 5 and FIG. 6 when taken together as shown in FIG. 7 represent a timing chart of the wave forms of various signals produced at defined points in the logic circuit block diagram of FIG. 4.
Figure 6:
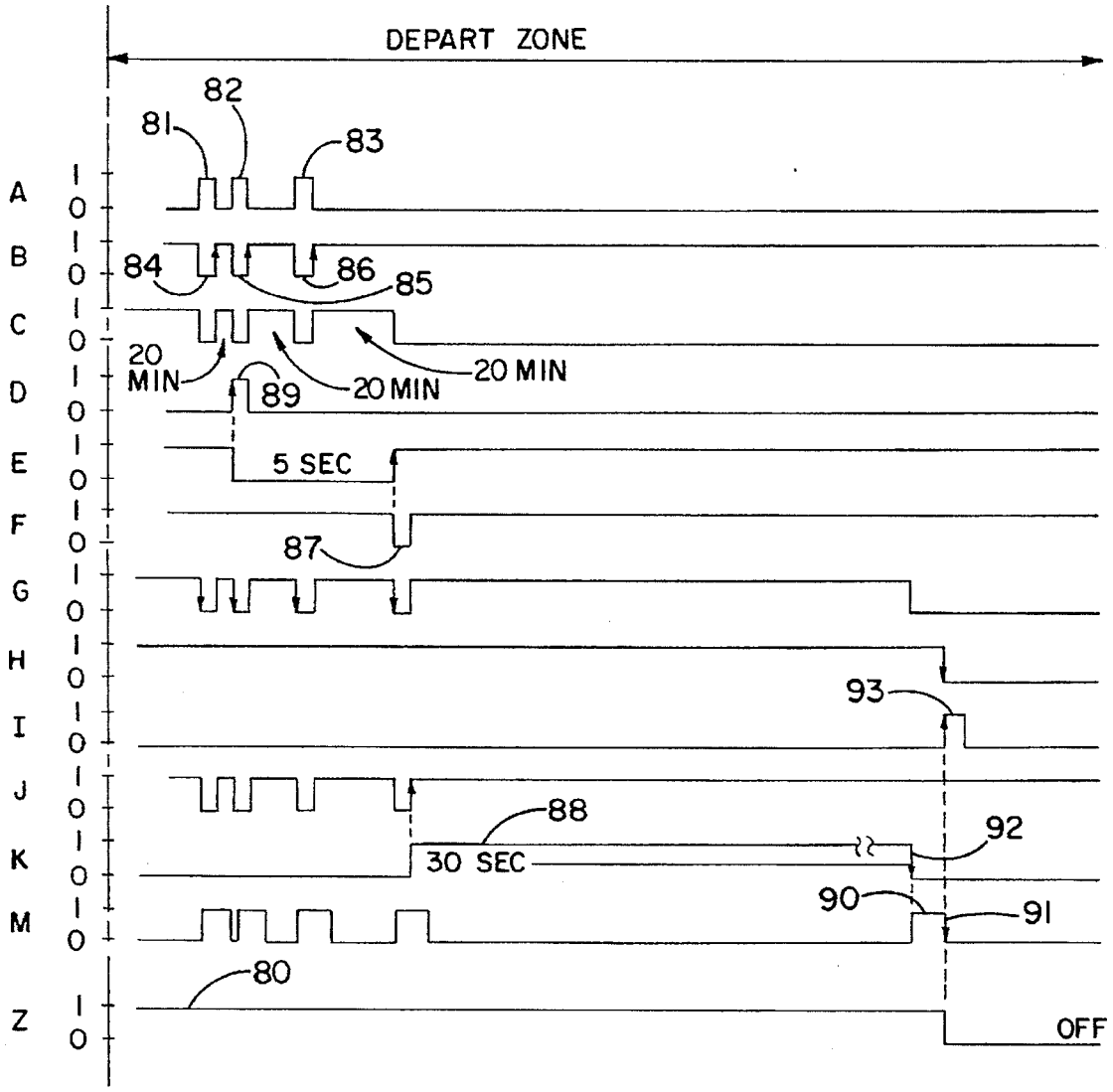
Figure 7:
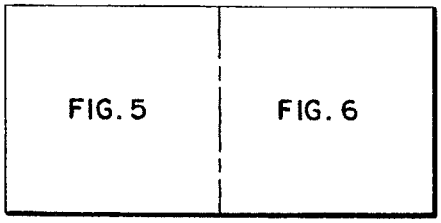

Reference is now made to FIGS. 5 and 6 which when taken together as shown in FIG. 7 form a timing chart of wave forms of various signals at points of reference within the logic circuitry of FIG. 4 just described. The points of reference are characterized by capitalized letters such as "A","B" etc.

The timing charts are intended to explain the operation of the detection system that embodies the invention as described earlier. Simply stated a review of the timing charts will explain and provide an understanding of the invention as an object/person enters a detection zone followed by the detection system's confirmation that the object/person is moving within the zone during a preset time period. Later in time, upon departure from the detection zone by the object/person the detection system quickly turns "OFF" in a period of time shorter than the preset time.

The description that follows will move back and forth between the logic circuitry of FIG. 4 and the timing waveform charts of FIGS. 5 and 6.

An object presence signal on input lead 11 is shown on line A. For purposes of explanation let it be assumed that a pair of pulses 70,71 appear, which indicate some object has entered the zone. The pulses 70,71 will be delivered via leads 11, 14 to the flip-flop 16. The pulse 70 will set the object presence detection zone output signal on output lead 13, see line Z, high which indicates zone is occupied and lighting is turned "ON".

On line B of FIG. 5 the pulses 70,71 are shown inverted and are delivered, over lead 27, lead 28, thru AND gate 30, lead 31 31*a* to trigger multivibrator 29 "ON" for a preset time period, here selected to be 20 minutes. The 20 minute "ON" signal pulse is shown on line C and is further identified by reference numeral 73. This event is indicated at a point in time by the positive going edge of pulse 72. Note that an object departure signal pulse 74 on input lead 12 indicative of an objects entry into the zone has no effect on the output from the preset time delay multivibrator 29. The positive going edge of pulse 74 does however trigger multivibrator 46, which has a normally high output, to go low for a 5 second period of time, as shown on line E of the timing chart. At the end of this 5 second period when the signal goes positive as indicated by reference numeral 75 the multivibrator 48 produces a negative going pulse 76 as shown on line F.

The output of the 20 minute long time delay multivibrator 29 is retriggered when both the output on line J, along with lead 27 provides a positive going edge, see reference numeral 77. FIG. 4*a* is a truth table for an AND gate, whereas FIG. 4*b* is a truth table for an OR gate.

It should be apparent that as long as the 20 minute long time delay signal on lead 32 remains high or "ON", the OR gate 56 provides on leads 57,58 the waveform shown on line G of the waveform chart.

What is being observed by the pulse wave form line by line analysis is that the object presence detection zone output remains "ON" as shown on line Z of the waveform chart as long as the 20 minute long, time period of multivibrator 29 is triggered and retriggered "ON", when for example as indicated by pulse waveform 78 a confirming motion presence in the zone is indicated as having occurred within 30 seconds of an object/person entering the detection zone.

The same object presence detection zone output "ON" output signal is retriggered as indicated by object presence signal 79 (line A) that occurs prior to the end of the 20 minute time delay period.

The soul of this invention may best be appreciated by a joint study of FIGS. 4,5 and 6 with specific attention being directed to the waveform pulse pattern evidenced in FIG. 6 during a moment of departure of an object/person from the detection zone.

Accordingly it will be observed that on line Z of the timing chart the object presence detection zone output signal (80; FIG. 6) on output lead 13 (FIG. 4) is "ON".

As an object/person approaches a perimeter of the detection zone prior to departure, line A, FIG. 6 shows a series of exemplary pulse waveforms 81, 82, 83 indicative of an object presence signal on input lead 11. As described earlier, line B of the timing chart shows inverted pulses 84, 85, 86 which appear at point B of the logic circuit diagram of FIG. 4.

No further commentary will be offered regarding the pulse waveform patterns on lines C,D,E and F as these waveform pulses and their function have been described earlier.

It should be recalled the pulse waveform signal 87 which appears on lead 49 of the zone departure initiating circuit 45 is the only signal that can trigger a 30 second exit moment of time delay signal 88 of line K on lead 34 to OR gate 56. Note also object departure pulse signal 89 on line D of FIG. 6. With attention directed to exit departure pulse 89 it will be appreciated that three (3) lines above in line A that object presence pulse 81 appears slightly ahead in time the object departure signal 89, whereas object departure signal 82 appears coincidently in time with object departure pulse 89. Note also the appearance of object presence signal 83 is intended to indicate that an object/person is continuing to be detected for a brief period of time after departure from the detection zone.

What is next to be observed is that the long time delay control of the detection system provided multivibrator 29 is being taken away and being placed under the control of the exit time delay multivibrator 33 which provides the 30 second exit moment of departure time delay signal 88 noted earlier. The 30 second moment of departure time delay signal 88 has been set at 30 seconds. During this 30 second moment of departure the rest of the system is waiting to see if any motion is detected in the detection zone to retrigger the 20 minute long time multivibrator 29. Absent the appearance of any motion presence detection signal on input lead 11, i.e. line A, the negative going edge 92 of the 30 second time delay pulse 88 to the multivibrator 60 produces pulse 90 (line M). The negative going edge (see 91,line M) of which via lead 61, OR gate 62, lead 62*a*, and multivibrator 65 triggers pulse 93 on lead 63 to flip-flop 16 which resets to "OFF" the Z signal 80 on output lead 13.

The net result of the just described 30 second turn "OFF" upon object/person departure, means a 19.5 minute saving of needless electrical power usage brought about by a momentary visitor to the detection zone. Not only a momentary visitor departure but any departure by person from the zone produces the 19.5 minute savings in electrical power when no motion of anyone is detected in the detection zone during the 30 second moment of departure. In small home or office environments the savings are significant. In large office complexes the saving are monumental and in the country as a whole the savings in electrical power expense defy easy calculation because of their enormity.

Now that the essence of the invention, which is the automatic turning off of power to a zone/room immediately upon departure of an object/person, is appreciated, attention is directed to the timing charts of FIG. 8 where additional system operation will be described.

Figure 8:
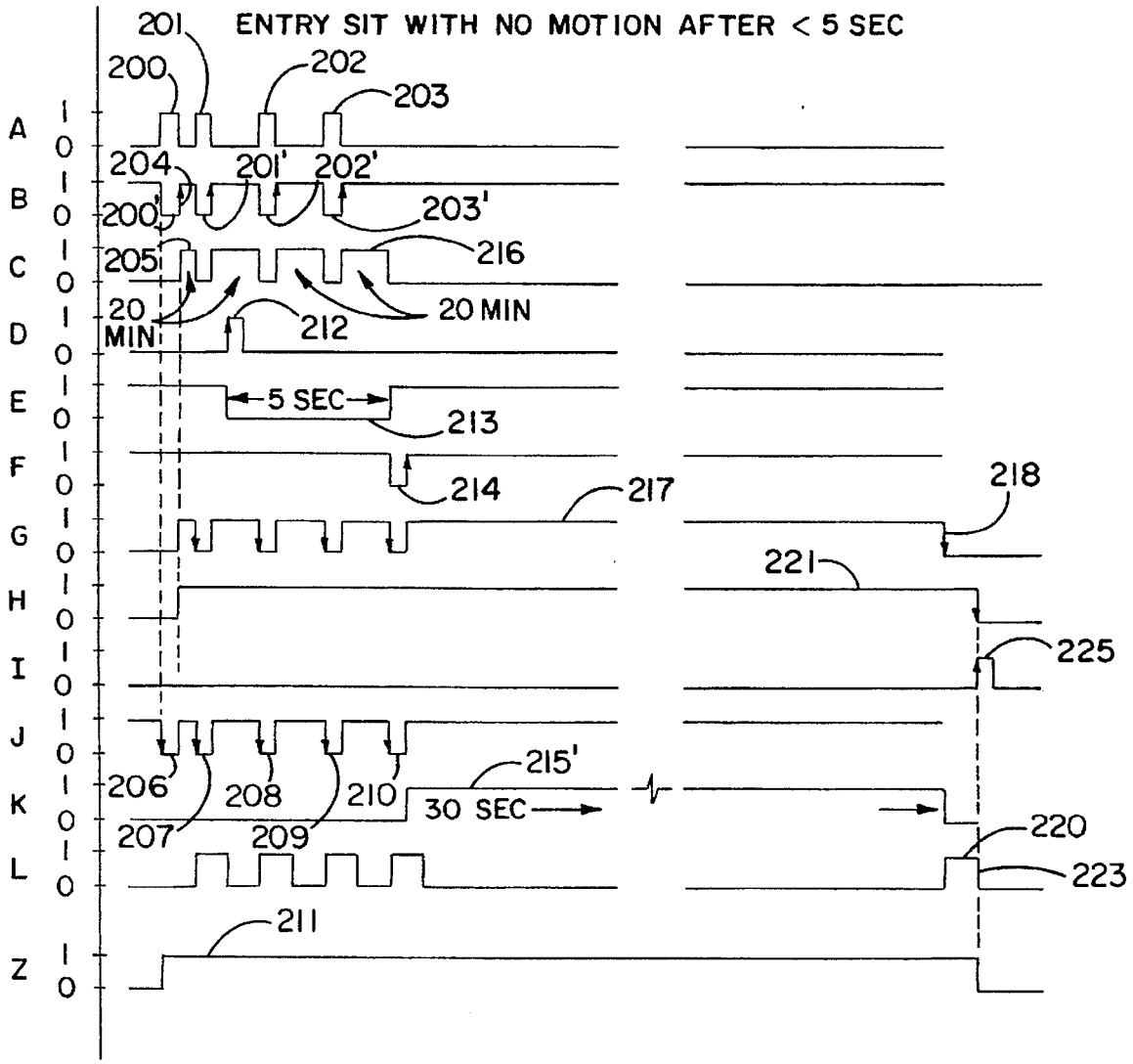
FIG. 8 is another timing chart depicting a facet of system operation.

Attention is now directed to FIG. 8 which is a timing chart of pulse waveforms which are intended to show, when studied in conjunction with the logic circuitry of FIG. 4 a situation where an object/person enters a detection zone and then remains motionless for the first 5 seconds of zone occupancy. FIG. 8 also illustrates a situation where the object/person is detected slightly in time before actually entering the detection zone. This situation may arise when an object presence detector 107 (FIG. 9) detects a person 114 as shown just prior to passing an exit/departure detection apparatus 110 to be described more fully hereinafter.

Line A of FIG. 8 shows a series of object presence signal pulses 200, 201, 202, 203. Object presence pulses 200 and 201 are representative of the detection of an object/person 114 just prior to entering a room/detection zone (FIG. 9) whereas object presence pulses 202, 203 represent object detection in the detection zone.

The pulses waveforms 200', 201', 202', 203' on line B simply represent the complement of the object presence pulses on 200, 201, 202, 203 on line A.

The positive going edge 204 of pulse 200' triggers "ON" a 20 minute long delay multivibrator 29 to initiate a 20 minute time delay pulse 205 as shown on line C.

The AND gate 30 leads 28 and 50 are normally high i.e. "1" (see lines B and F) which results in a normally high "1" on the AND gate output lead 31 (see line J). Accordingly, when negative going pulse waveform 200' on lead 28 appears the output pulse 206 on lead 31 of the AND gate 30 resets the 20 minute time delay multivibrator 29 which is then triggered "ON" by the positive going edge 204 of pulse 200'. It is to be noted that the negative going pulses 207, 208, 209 and 210 which appear on line J as well as leads 31 and 31*a*, 31*b* act to reset the long time delay i.e. 20 minute time delay, multivibrator 29 and the 30 second exit/departure time delay multivibrator 33.

Returning again to line A of FIG. 8, object presence signal 200 appears on input lead 11 and lead 14 to the flip-flop 16 which sets the flip-flop 16 "ON'" as is evidence by object presence detection zone output signal 211 shown on line Z.

When attention is directed to line D of FIG. 8 the detection system will always provide a signal pulse on input lead 12, FIG. 4 whenever an object/person enters or exits the detection zone. Accordingly pulse waveform 212 on line D cause multivibrator 46 to provide the negative going pulse 213 of 5 second duration as shown on line E. At the end of the 5 second pulse 213 multivibrator, 48 provides a negative going pulse 214, line F, on lead 49 which is delivered via leads 49, 51, so, thru gate 30, output 31, 31*b* to reset and trigger "ON" the 30 second time delay multivibrator 33 to provide the positive going 30 second signal 215.

It is important to note that at the end of the 5 second signal 213, as shown on line E, the negative going edge of signal 213 delivered via lead 47 to multivibrator 48 causes multivibrator 48 to deliver an output pulse 210 on lead 49 to reset multivibrator 29 to "OFF" thereby ending the 20 minute time delay output as is indicated by pulse waveform 216 on line C.

Attention is now directed to OR gate 56 and its inputs on leads 32, 34 and output on lead 57. The nature of input on lead 32 is represented by the pulse waveform on line C and the nature of the input lead 34 is represented by pulse waveform on line K, whereas the nature of the pulse waveform on output lead 57 is represented by the pulse waveform on line G. It will be observed that the input signal level on OR gate input leads 32, 34 are normally low.

When the input signal on lead 32 goes high as happens when the 20 minute time delay signals on line C appears we 'observe the output of OR gate on line G going high. In other words anytime the input signals or either leads 32 or 34 go high the output of the OR gate 56 lead 57 i.e. line G go high. Accordingly when the 30 second time delay signal 215 on lead 34 is high the output on OR gate 56 lead 57 i.e. waveform 217 on line G will go high.

The operation of retrigger hold delay unit will now be described, given the scenario now under review. It will be observed that the negative going edge 218 of pulse 217 line G delivered via leads 57, 59 from OR gate 56 will trigger "ON" multivibrator 60 to provide positive going pulse 220 on lead 61, see line M.

Attention is now directed to OR gate input lead 58 which is high, see pulse 217, line G, which keeps the OR gate 56 signal 221 high. As pulse 217, line G goes negative 218, the pulse 220 on lead 61 line M goes positive for a short moment whereas the negative going edge indicated by 223, triggers multivibrator 65 to deliver pulse 225, line I, via lead 63 to reset flip-flop 16 thereby resetting the output presence detection zone signal 13 to "OFF".

Figure 9:
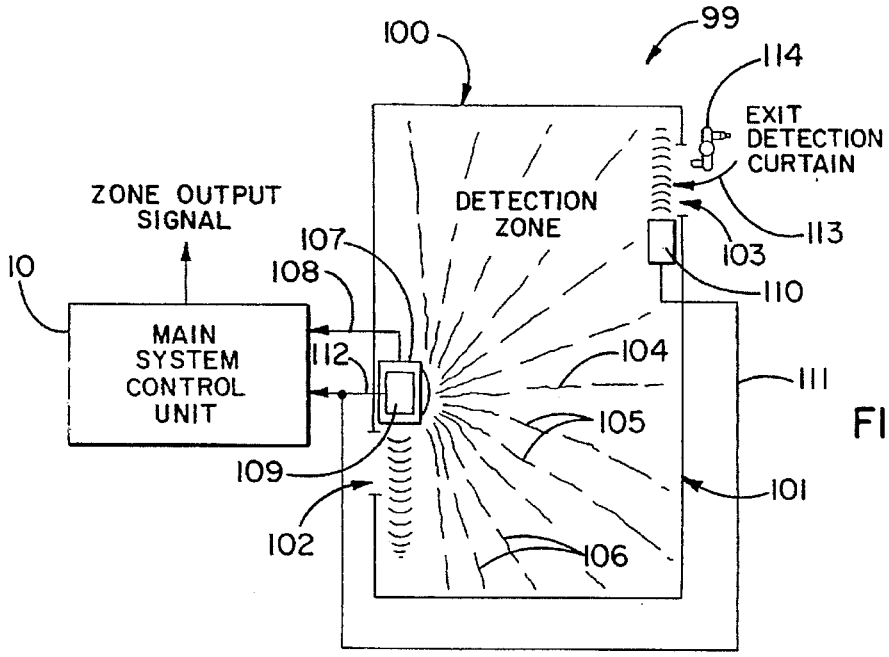
FIG. 9 is a schematic of the invention finding utility in a detection zone characterized by a room having a plurality of openings that allow entrance and departure from a detection zone.

The embodiment of the invention as shown in FIG. 9 is that of a typical office/room 99 as defined by walls shown schematically as lines 100, 101. The walls are provided with door openings 102, 103. The walls of the room 99 define a detection zone labeled as such. Wavy lines such as 104, 105, 106 are intended to represent the presence of either a passive or active detection zone depending upon the object detection apparatus employed.

An object presence detector 107 is shown positioned on a wall adjacent door opening 102. The object presence detector 107 provides via lead 108 to the main systems control unit an object presence detection signal of the nature previously described.

Exit/departure detection apparatus 109, 110 are shown by door openings 102, 103. These exit/departure detection apparatus may be made a physical part of the object presence detector 107 or exist as separate units. In this embodiments the exit/departure detection apparatus are shown electrically interconnected by leads 111,112. The lead 112 delivers to the main system control unit 10 an object departure signal whenever an object/person is detected passing through either of the door openings 102, 103.

Figure 12:
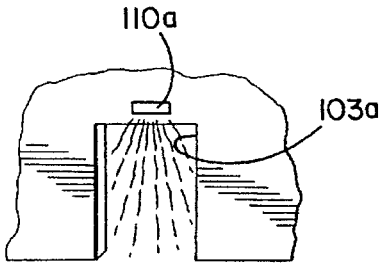
FIG. 12 illustrates partial section of a door or passageway having in place an object departure curtain sensor.

The exit/departure detection apparatus 109, 110 may be selected from a large variety of commercially available devices for detecting motion of an object between to points that define an opening or passageway. FIG. 12 shows a similar detection apparatus 110*a* above a door opening 103*a*. These devices may be active, passive, optical, microwave or infrared to name a few. At door opening 103 there is a legend indicating "Exit Detection Curtain" and arrow 113 point to a series of parenthesis shaped lines that are laid out in a row to indicate an invisible curtain through which objects/persons pass and are detected. FIG. 9 also shows schematically a person 114 just after leaving the detection zone or alternatively approaching the detection zone. It will be noted that the invention as described earlier accommodates a detection of an individual for a few seconds after the person has exited the zone and still resets the output presence detection zone signal to "OFF" after a moment of departure from the zone.

Figure 10:
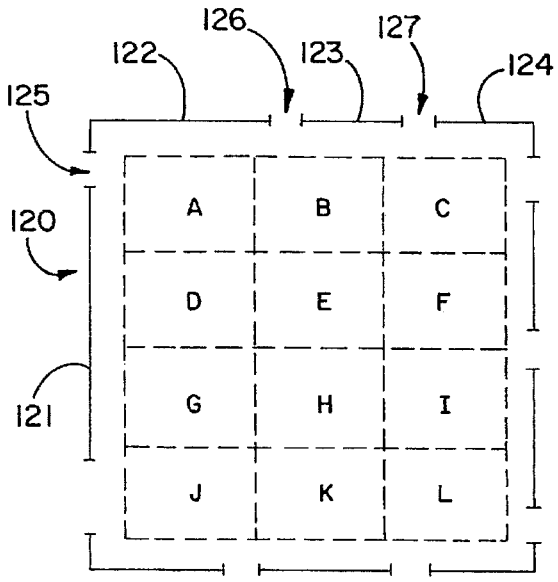
FIG. 10 is a schematic showing of an open office or work area with a plurality of contiguous detection zones.
Figure 11:
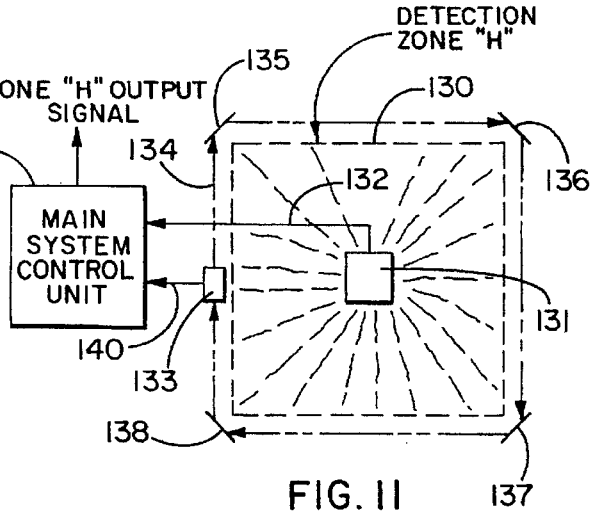
FIG. 11 is a schematic of a selected detection zone of FIG. 8 showing an embodiment of the invention being utilized to detect objects within the selected detection zone.

Attention is now directed to FIGS. 10 and 11 which when studied together reveal another embodiment of the invention. FIG. 10 is intended to depict schematically a large wide open office layout 120 having exterior walls shown as lines, eg. lines 121, 122, 123, 124, and door openings eg. 125, 126, 127. Within the exterior walls of wide open office layout 120 are schematically indicated a plurality of detection zones A thru L Although not shown these zones are filled with low level partitioned work areas and desks. Normally ceiling lighting is provided in a grid like manner to provide individual lighting to the detection zones A thru L. One such detection zone "H" is shown in FIG. 11. The perimeter of the detection zone "H" is depicted in broken line 130. Centrally disposed in a ceiling above the detection zone "H" is an object presence detector 131. The detector 131 delivers on an electrical lead 132 to a main system control unit 10 an object presence signal whenever an object/person is detected in Zone H.

An exit/departure detection apparatus 133 of an optical type is shown delivering a light beam 134 to zone corner mounted light reflectors 135, 136, 137, and 138. If any object/person physically interrupts the light beam 134 the exit/departure detection apparatus 133 produces in a wholly conventional manner an object/person departure signal on electrical lead 140.

It should be easy to appreciate that if each of the detection zones A to L were equipped with apparatus of the inventive system, a person could move freely through the wide open office area and the lighting in the ceiling above would light a path to the zone in which the worker was stationed. The lighting in the ceiling would turn off in a path behind the person moving toward their work station. This type of light control is especially useful during off-hours, i.e. evenings and weekends. During normal working hours it would be a simple task to override individual zone operation and turn all lights "ON" and "OFF" for blocks of time commensurate with normal working hours.

For those skilled in the art it will be readily apparent that the system described herein as one made up of logic circuitry could equally well accomplish all the functional features of the system by means of computer software and state of the art programming.

From the foregoing it will also be appreciated that the invention also provides a method of detecting object presence in a detection zone and for always detecting an objects departure from the zone to provide an object presence detection zone output signal which when "ON" indicates the presence of an object in the zone or a zone output signal which is "OFF" an instant in time following a moment of departure of the object from the zone. This "OFF" signal happens when no presence of an object in the detection zone is detected during the moment of departure. The method specifically entails the steps of (a) detecting the presence of an object in the detection zone to set "ON" the object presence detection zone output signal for a preset time period; (b) retriggering the preset time period as long as object presence is detected in the zone; (c) detecting object departure from the zone, and (d) resetting to "OFF" the object presence detection zone output signal at an instant in time just after the moment in time an object has been detected departing the detection zone and no object has been detected in the zone during the moment in time, the moment in time always being selected to be shorter in time than the preset time period.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

What I claim as new:

1. A detection system for detecting object presence in a detection zone and for quickly detecting object departure from said detection zone so as to provide an object presence detection zone output signal indicative of zone occupancy, said system comprising:

an object presence detection means to provide an object presence signal when an object is detected in said zone;

an object departure detection means to provide an object departure signal when an object is detected departing said zone;

a main control means that is responsive to said object presence signal from said detection zone and said object departure signal provided from said zone, said object presence signal causing said object presence detection zone output signal to turn "ON" and remain "ON" for a preset time period which object detection zone output "ON" signal is maintained "ON" for as long as object presence is detected in said zone, and said object departure signal causing said object presence detection zone output signal to "OFF" a moment in time after an object departs said zone if no object has been detected in said zone during said moment in time, said moment in time always being shorter than said preset time period.

2. A detection system for detecting object presence in a detection zone and quickly detecting object departure from said detection zone so as to provide an object presence detection zone output signal indicative of zone occupancy, said system comprising:

an object presence detection means to provide an object presence signal when an object is detected in said zone;

an object departure detection means to provide an object departure signal when an object is detected departing said zone;

a main system control means that is responsive to both said object presence signal from said zone and said object departure signal from said zone to turn "ON" and "OFF" the object presence detection zone output signal, said object presence signal acts to trigger said object presence detection zone output signal "ON", said object presence detection zone output signal remaining "ON" for a preset period of time and maintained "ON" as long as a presence of an object in said zone is detected, said object departure signal causes a moment of departure time delay signal which interrupts said object presence detection zone output "ON" signal and causes said object presence detection zone output signal to turn "OFF" when no object presence is detected in said zone during said moment of departure time delay, said main system control means further being responsive to said object presence detection zone output "ON" signal and said moment of departure time delay signal to ensure that said object presence detection zone output signal is "ON" during detection of objects in said zone and during said moment of departure time delay, and is turned "OFF" a moment in time after an object departs said zone if no object has been detected in said zone during said moment in time.

3. A detection system of claim 2 wherein said responsive means includes a long time delay means and moment of departure delay means responsively coupled to receive said object presence signal, a zone departure initiating means responsively coupled to said object departure signal to thereby provide a departure indicating signal to said long time delay means and said moment of departure delay means to thereby establish said object presence detection zone output signal which is "ON" for a preset time period and said moment of departure time delay signal.

4. The detection system of claim 3 wherein said object presence detection zone output signal preset time period is always of a longer duration in time than said moment of departure time delay signal.

5. A detection system for detecting object presence in a detection zone and quickly detecting object departure from said detection zone to provide an object presence detection zone output signal indicative of zone occupancy, said system comprising:

a main system control means that is responsive to both an object presence signal from said detection zone and an object departure signal from said zone to provide said object presence detection zone output signal, said responsive means providing;

a preset time period "ON" signal, and a moment of departure time delay signal, said object presence signal initiating said preset time period "ON" signal, said preset time period "ON" signal causing an object presence detection zone output signal to turn "ON" and remain "ON" as long as presence of an object in said zone is detected, said object departure signal causing said moment of departure time delay signal which is representative of object departure from said zone, said moment of departure time delay signal interrupts said object presence detection zone output "ON" signal when no object presence is detected in said zone during moment of departure time delay, said main system control means further including holding means responsive to said preset time period "ON" signal and said moment of departure time delay signal to deliver a zone unoccupied signal to said responsive means to ensure that said object presence detection zone output signal is "ON" during detection of objects in said zone and during said moment of departure time delay and said object presence detection zone output signal is reset "OFF" a moment in time after an object departs said zone if no object has been detected in said zone during said moment in time.

6. The detection system of claim 5 wherein said preset time period signal is always of a longer duration in time than said moment of departure time delay signal.

7. A method of detecting object presence in a detection zone and for quickly detecting object departure from said detection zone to provide an object presence detection zone output signal which is "ON" to indicate the presence of an object in said zone and turns "OFF" an instant in time following a moment of departure of said object from said zone when no object is detected in said detection zone during said moment of departure, said method comprising the steps of;

(a) detecting the presence of an object in said detection zone to set "ON" said object presence detection zone output signal for a preset time period, (b) maintaining said preset time period object presence detection zone output signal as long as object presence is detected in said zone, (c) detecting object departure from said detection zone, and (d) resetting to "OFF" said object presence detection zone output signal at an instant point in time just after a moment in time an object has been detected departing said detection zone and no object has been detected in said zone during said moment in time.

8. The method of claim 7 wherein said moment in time is always shorter in time than said preset time period.

* * * * *